US009534486B2

(12) United States Patent
Wisinger, Jr. et al.

(10) Patent No.: US 9,534,486 B2
(45) Date of Patent: Jan. 3, 2017

(54) METHOD AND SYSTEM FOR TRACKING TIME IN A DOWNHOLE TOOL WITHOUT THE NEED FOR A BATTERY

(71) Applicant: Halliburton Energy Services, Inc., Houston, TX (US)

(72) Inventors: John Leslie Wisinger, Jr., Spring, TX (US); Ranganathan Sridharan, Kingwood, TX (US)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 505 days.

(21) Appl. No.: 14/209,891

(22) Filed: Mar. 13, 2014

(65) Prior Publication Data

US 2015/0260030 A1 Sep. 17, 2015

(51) Int. Cl.

| | |
|---|---|
| ***E21B 47/00*** | (2012.01) |
| ***E21B 41/00*** | (2006.01) |
| ***G04C 11/00*** | (2006.01) |
| ***G04G 7/00*** | (2006.01) |

(52) U.S. Cl.

CPC ..... *E21B 47/00* (2013.01); *E21B 41/00* (2013.01); *G04C 11/00* (2013.01); *G04G 7/00* (2013.01)

(58) Field of Classification Search

CPC ..... E21B 47/00; E21B 41/00; G04C 11/00; G04G 7/00

See application file for complete search history.

(56) References Cited

U.S. PATENT DOCUMENTS

| | | | | |
|---|---|---|---|---|
| 5,363,377 | A | 11/1994 | Sharpe | |
| 6,400,646 | B1 | 6/2002 | Shah et al. | |
| 6,618,674 | B2 * | 9/2003 | Ireland | G01V 1/40 367/82 |
| 6,829,200 | B1 | 12/2004 | Berstis et al. | |
| 6,910,147 | B2 | 6/2005 | Needham | |
| 6,990,045 | B2 | 1/2006 | Jackson | |
| 7,142,129 | B2 * | 11/2006 | Hall | E21B 47/12 340/853.3 |
| 7,633,834 | B2 | 12/2009 | Mathiszik et al. | |
| 7,675,816 | B2 | 3/2010 | Mathiszik et al. | |
| 7,719,996 | B2 | 5/2010 | Schroeder | |
| 7,969,819 | B2 | 6/2011 | Hall et al. | |
| 8,107,317 | B2 | 1/2012 | Underhill et al. | |

(Continued)

FOREIGN PATENT DOCUMENTS

CN 102647269 8/2012

OTHER PUBLICATIONS

English abstract for CN102647269; published on Aug. 22, 2012 and retrieved on Dec. 17, 2013.

*Primary Examiner* — Rodney Bonnette
(74) *Attorney, Agent, or Firm* — Polsinelli PC

(57) ABSTRACT

Time is tracked in a downhole tool to indicate whether timestamps associated with data samples or events in a log indicate either real time or a duration of time since a certain reset, and to indicate whether the timestamps have been synchronized with a master clock in the tool. The log also records the time and offset of each synchronization event. A computer processes the log to convert all of the timestamps to real-time values and to indicate timestamps that have been estimated and timestamps that were never synchronized to a master clock in the tool. The computer determines an associated uncertainty for each of the estimated timestamps.

20 Claims, 12 Drawing Sheets

(56) References Cited

U.S. PATENT DOCUMENTS

| | | | | |
|---|---|---|---|---|
| 8,514,098 | B2 | 8/2013 | Montgomery et al. | |
| 2008/0137474 | A1 | 6/2008 | Dashevskiy et al. | |
| 2010/0313646 | A1 | 12/2010 | Mehta et al. | |
| 2012/0254418 | A1 | 10/2012 | Callagham et al. | |
| 2013/0080102 | A1* | 3/2013 | Seydoux ..... | G01V 3/28 702/89 |

* cited by examiner

210

| BIT 32 | BIT 30 (SYNC) | BITS 29-19 | BITS 18-0 |
|---|---|---|---|
| 1 | 0/1 | RESET NUMBER (0-2047) | SECONDS SINCE RESET (≈6 DAYS) |
| 211 | 212 | 213 | 214 |

FIG. 9

220

| BIT 32 | BIT 30 (SYNC) | BITS 29-0 |
|---|---|---|
| 0 | 0/1 | REAL TIME IN SECONDS SINCE 1/1/2012 (34 YEARS) |
| 211 | 212 | 215 |

FIG. 10

230

| FIELD NAME | UNITS | DISPLAY | COMMENTS |
|---|---|---|---|
| ToolID | NONE | NO | USED BY THE SURFACE PC FOR PUTTNG THIS TIME CORRECTON EVENT IN THE FIELD REPORT FOR THIS TOOL SUB-UNIT |
| LocalTime | NONE | NO | USED BY THE SURFACE PC TO CORRELATE THE TIME BEFORE THE SYNCING TO THE TIME AFTER THE SYNCING |
| SyncedTime | NONE | NO | USED BY THE SURFACE PC TO CORRELATE THE TIME BEFORE THE SYNCING TO THE TIME AFTER THE SYNCING |

FIG. 11

294

| | | | SENT TO SURFACE | | SENT TO SURFACE | | | | | SENT TO SURFACE |
|---|---|---|---|---|---|---|---|---|---|---|
| RESET NUMBER | 1 | 1 | 1 | 1 | 1 | 2 | 2 | 3 | 3 | 3 |
| SECONDS SINCE RESET | 0 | 10 | 20 | 30 | 40 | 0 | 10 | 0 | 10 | 20 |
| REAL TIME | 12:00:00 | 12:00:10 | 12:00:20 | 12:00:30 | 12:00:40 | 12:00:50 | 12:01:00 | 12:01:10 | 12:01:20 | 12:01:30 |

FIG. 18

METHOD AND SYSTEM FOR TRACKING TIME IN A DOWNHOLE TOOL WITHOUT THE NEED FOR A BATTERY

FIELD

The subject matter herein generally relates to downhole well logging, and more specifically relates to a method of tracking time in a downhole tool that is subject to loss of power while recording downhole data.

BACKGROUND

A downhole well logging tool typically has one or more sensor sub-units. Each sensor sub-unit has a cylindrical section of pipe enclosing one or more sensors and a micro-controller having non-volatile memory for storing a log of sensor data. For example, the sensor data indicates inclination, temperature, pressure, vibration, magnetic field, and gamma rays.

Although a sensor sub-unit may contain a battery for powering the sensor sub-unit, it is not uncommon for the sensor sub-unit to be powered by a battery or mud turbine in a separate sub-unit that is shared among the sensor sub-units. For example, a typical downhole sensor sub-unit without a battery may operate at temperatures up to 230 degrees Centigrade, which is higher than the permissible operating temperatures of common batteries. For reliable operation at such high temperatures, a sensor sub-unit may be powered by a mud turbine instead of a conventional battery. Consequently, it is convenient to build sensor sub-units without batteries. This permits downhole well logging tools to be configured from selected sub-units to suit a wide range of downhole environments.

A conventional log of data from a sensor is a time series of periodic samples of data from the sensor. In a sensor sub-unit, each sample of the data is taken at a particular time in response to a clock signal in the sensor sub-unit. Each sample of sensor data is recorded in a sensor log. For each sample of sensor data, an associated time value is also recorded in the sensor log. The association of the time value with each sample is used to determine the depth of the sensor in the wellbore at the time that the sample was taken. Typically this is done by correlating the real time of the sample with the depth as a function of time as determined by tracking of the movement of the logging tool in the wellbore. For logging while drilling, the movement of the logging tool in the wellbore can be tracked by observation of the drill string sections as the drill string sections are lowered into the well head or a drilling riser. For wireline logging, the movement of the logging tool in the wellbore can be tracked by measuring the play-out of the wireline from a spool as the logging tool is lowered into or raised from the wellbore.

By correlating the sensor samples with depth, a view of the formation surrounding the wellbore can be constructed from the sensor samples. By precisely correlating sensor samples with depth, it becomes possible to combine sensor data from different logging tools used at different times in order to provide a more detailed view of the formation surrounding the wellbore. Without precise or accurate real-time values for the sensor samples, there can be a loss of precision or accuracy in the constructed view of the formation surrounding the wellbore.

BRIEF DESCRIPTION OF THE DRAWINGS

FIG. 9 shows a sensor log record format of a local time value expressed as a duration of time since a certain reset;

FIG. 10 shows a sensor log record format of a real time value;

FIG. 11 is a table defining fields of a sensor log record for recording a synchronization event for a sub-unit;

FIG. 18 is a table showing a correlation of local time in a sensor sub-unit with real time and transmission of local time values from the sensor sub-unit to the surface at various times.

DETAILED DESCRIPTION

Figure 1:
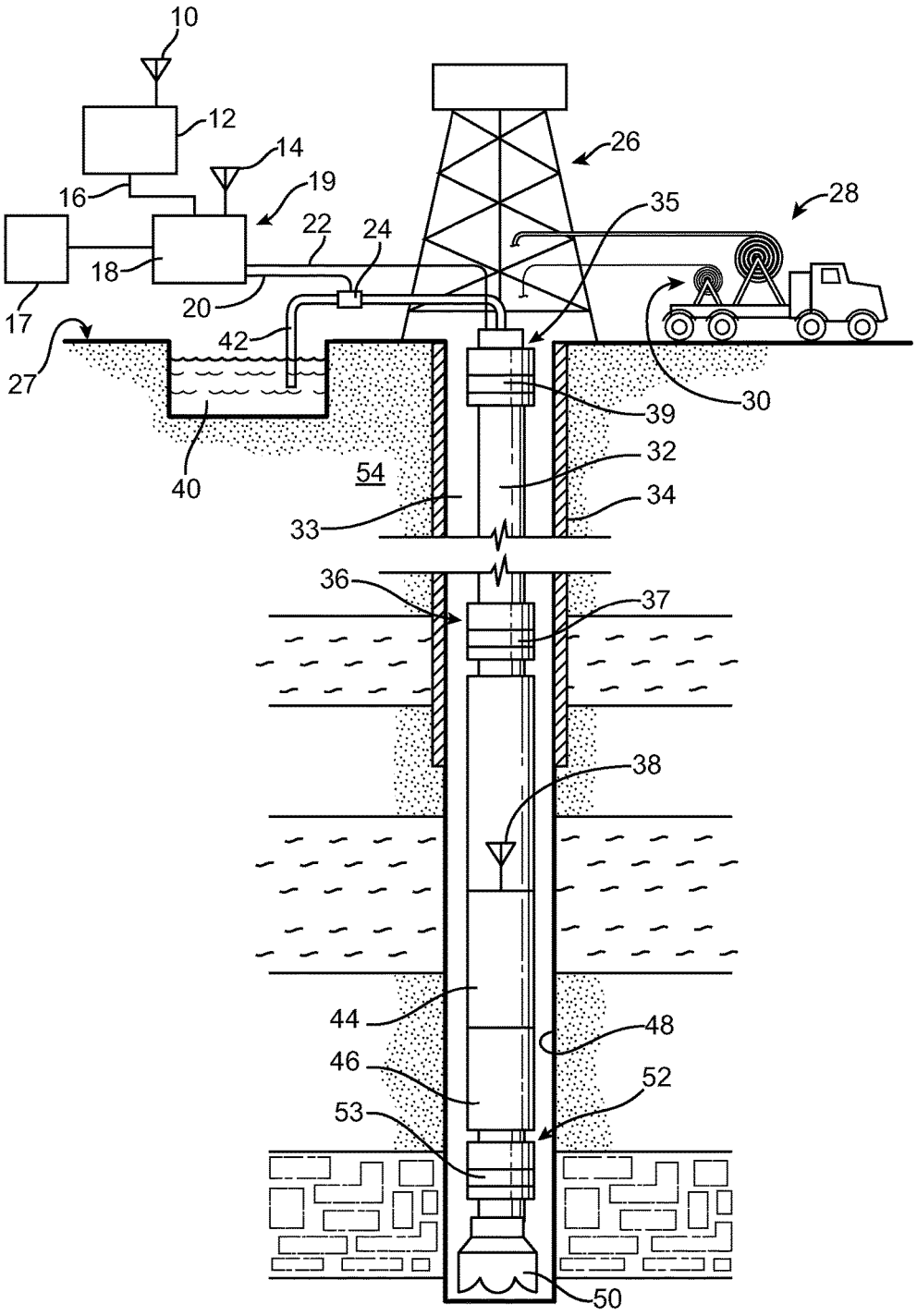
FIG. 1 is a schematic diagram of a system for well logging while drilling a wellbore.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Claim language reciting "at least one of" a set indicates that one member of the set or multiple members of the set satisfy the claim.

The present disclosure is described in relation to a downhole logging tool. As described above, a downhole well logging tool typically has one or more sensor sub-units. Each sensor sub-unit has a cylindrical section of pipe enclosing one or more sensors and a micro-controller having non-volatile memory for storing a log of sensor data. For example, the sensor data indicates inclination, temperature, pressure, vibration, magnetic field, and gamma rays.

The present disclosure is described in relation to a subterranean well that is depicted schematically in FIG. 1. A wellbore 48 is shown that has been drilled into the earth 54 from the ground's surface 27 using a drill bit 50. The drill bit 50 is located at the bottom, distal end of the drill string 32 and the bit 50 and drill string 32 are being advanced into the earth 54 by the drilling rig 26. The drilling rig 26 can be supported directly on land as shown or on an intermediate platform if at sea. For illustrative purposes, the top portion of the well bore 48 includes casing 34 that is typically at least partially comprised of cement and which defines and stabilizes the wellbore 48 after being drilled.

As shown in FIG. 1, the drill string 32 supports several components along its length. A sensor sub-unit 52 is shown for detecting conditions near the drill bit 50, conditions which can include such properties as formation fluid density, temperature and pressure, and azimuthal orientation of the drill bit 50 or string 32. In the case of directional drilling, measurement while drilling (MWD)/logging while drilling (LWD) procedures are supported both structurally and communicatively. Moreover, the sensor sub-unit 52 can detect characteristics of the formation surrounding the wellbore 48 proximate the sensor sub-unit 52 such as resistivity and porosity. Other sensor sub-units 35, 36 are shown within the cased portion of the well which can be similarly enabled to sense nearby characteristics and conditions of the drill string, formation fluid, casing and surrounding formation. Regardless of which conditions or characteristics are sensed, data indicative of those conditions and characteristics is either recorded downhole, for instance at the processor 44 for later download, or communicated to the surface either by wire, wirelessly or otherwise. If wirelessly, the downhole transceiver (antenna) 38 can be utilized to send data to a local processor 18, via topside transceiver (antenna) 14. There the data may be either processed or further transmitted along to a remote processor 12 via wire 16 or wirelessly via antennae 14 and 10.

The use of coiled tubing 28 and wireline 30 for downhole deployment of the sensor sub-units is also schematically indicated and contemplated in the context of this disclosure.

The possibility of an additional mode of communication is contemplated using drilling mud 40 that is pumped via conduit 42 to a downhole mud motor 46. The drilling mud is circulated down through the drill string 32 and up the annulus 33 around the drill string 32 to cool the drill bit 50 and remove cuttings from the wellbore 48. For purposes of communication, resistance to the incoming flow of mud can be modulated downhole to send backpressure pulses up to the surface for detection at sensor 24, and from which representative data is sent along communication channel 20 (wired or wirelessly) to one or more processors 18, 12 for recordation and/or processing.

The sensor sub-unit 52 is located along the drill string 32 above the drill bit 50. The sensor sub-unit 52 carries acoustic apparatus 53 for transmitting, receiving, and processing acoustic signals passing along drill string 32 to and from the surface 27. For illustrative purposes, the sensor sub-unit 36 is shown in FIG. 1 positioned above the mud motor 46 that rotates the drill bit 50. Additional sensor sub-units 35, 36 can be included as desired in the drill string 32. The sensor sub-unit 52 positioned below the motor 46 has acoustic apparatus 53 to communicate with the sensor sub-unit 36 in order to relay information to the surface 27. Communication between the acoustic apparatus 53 below the motor 113 and the downhole acoustic apparatus 37 of the sensor sub-unit 36 can be accomplished by use of a short hop acoustic telemetry system.

At the surface 27, supported by the drill string 32, a surface sensor sub-unit 35 carries acoustic apparatus 39. The surface sensor sub-unit 35 can be supported also by the surface rig 26. Signals received at the acoustic apparatus 39 may be processed within the acoustic apparatus 39 or sent to a surface installation 19 for processing.

As shown in FIG. 1, the surface installation 19 includes a transceiver (antennae) 14 that can communicate with the surface sensor sub-unit 35, the personal computer 18 coupled to the transceiver 14 for processing the signals from the sensor sub-units 35, 36, 52, and a real-time clock 17 for time-stamping signals and sensor data from the sensor sub-units.

Power for the sensor sub-units and acoustic apparatuses in the sub-units may be provided by batteries housed therein. Alternatively, power may be generated from the flow of drilling mud through the drill string using turbines as is known in the art.

The present disclosure addresses problems that may arise among sensor data that has or has not been corrected for various offsets between a real-time clock at the surface, a real-time clock in the downhole logging tool, and the clock of a micro-controller in a sensor sub-unit that keeps track of clock cycles since the micro-controller was last reset.

Figure 2:
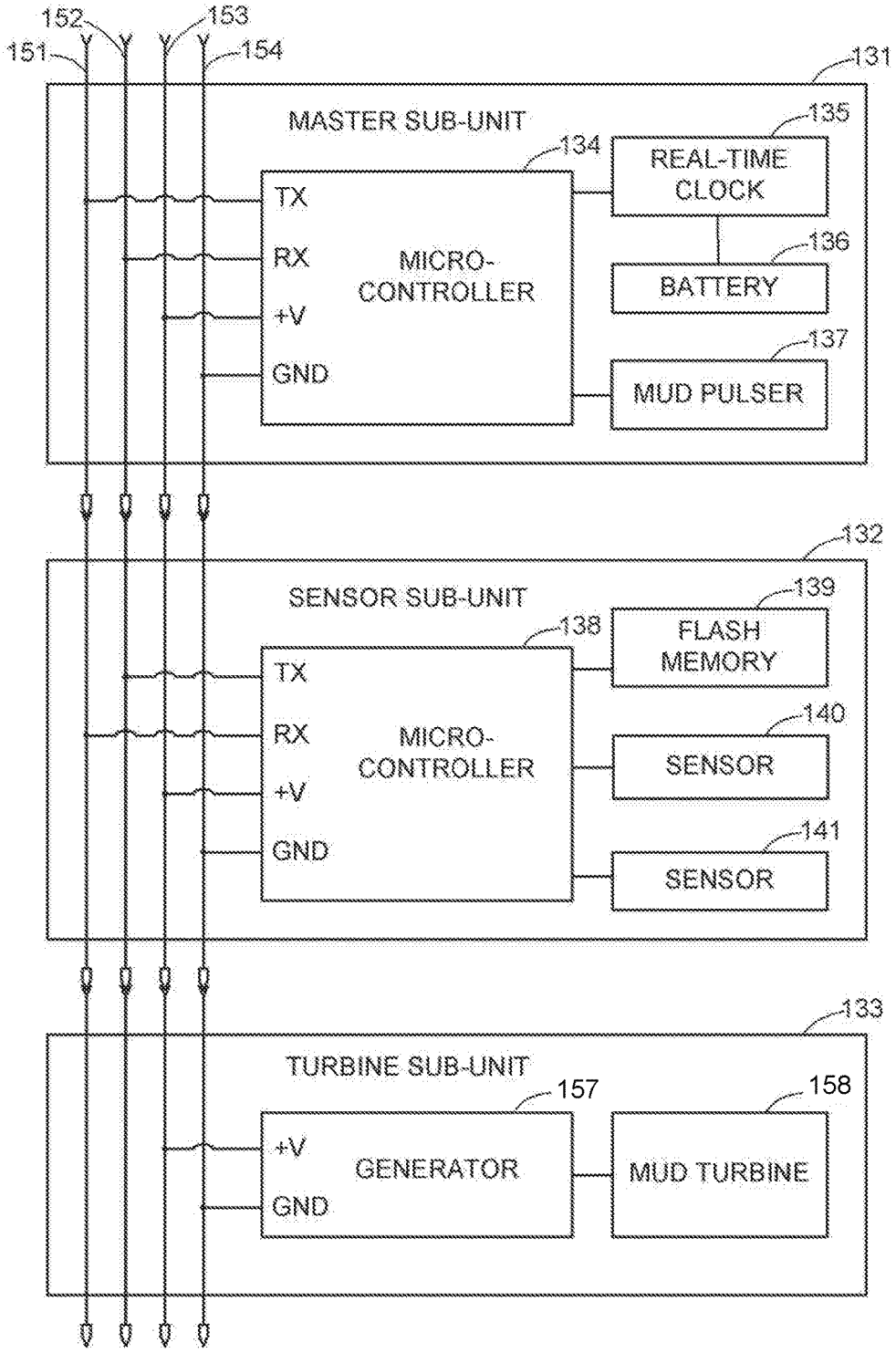
FIG. 2 is a schematic diagram of a master sub-unit, a sensor sub-unit, and a turbine sub-unit of a downhole logging tool.

FIG. 2, for example, shows different kinds of reconfigurable downhole logging tool sub-units 131, 132, and 133. The sub-units 131, 132, 133 can be arranged and interconnected in various ways while maintaining electrical continuity of electrical connections over a bus comprised of two data lines 151, 152 and a power line 153 and a ground line 154. The sub-units include a master sub-unit 131, a sensor sub-unit 132, and a turbine sub-unit 133.

The master sub-unit 131 has a micro-controller 134, a real-time clock 135 coupled to the micro-controller 134 for supplying a present real-time value to the micro-controller 134, and a battery 136 coupled to the real-time clock 135 for providing a continuous supply of power to the real-time clock 135. The master sub-unit also has a mud pulser 147 coupled to the micro-controller 136 for interrupting the flow of drilling mud though the master sub-unit in order to send data up to the surface from the downhole logging tool. The master sub-unit 131 periodically sends the current real time value to the sensor sub-unit 132.

The sensor sub-unit 132 has a micro-controller 138, a flash memory 139 coupled to the micro-controller 138 for storing sensor data, and a number of sensors 140, 141 coupled to the micro-controller for supplying the sensor data. The sensors 140, 141, for example, may include pressure sensors, temperature sensors, an inclinometer, a magnetometer, acoustic sensors, and gamma ray detectors.

The turbine sub-unit 133 includes a generator 157 driven by a mud turbine 158. Therefore the generator 157 does not necessarily supply power continuously to the sensor sub-unit 132, because the supply of power from the turbine sub-unit 133 is shut off when the flow of drilling mud is interrupted, for example, when a section of drill pipe is added to the drill string. In this case, the micro-controller 138 of the sensor sub-unit 132 will halt until the supply of power from the turbine sub-unit 133 is restored. When the supply of power is restored, the micro-controller 138 increments a reset count, and sends a reset signal including the number of the reset count to the master sub-unit 131. The master sub-unit receives the reset signal, and sends it up to the surface via the mud pulser 137 using mud pulse telemetry.

Figure 3:
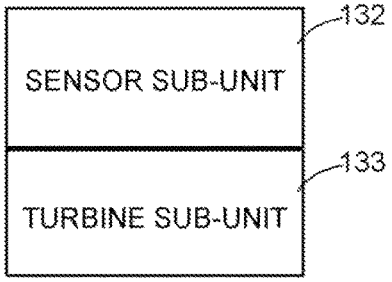
FIG. 3 is a block diagram of a downhole logging tool configuration including a single sensor sub-unit and a turbine sub-unit.

FIG. 3 shows a minimal configuration of sub-units for a downhole logging tool in which the turbine sub-unit 133 is used to power the sensor sub-unit 132, but the sensor sub-unit 132 does not have access to a master sub-unit.

Figure 4:
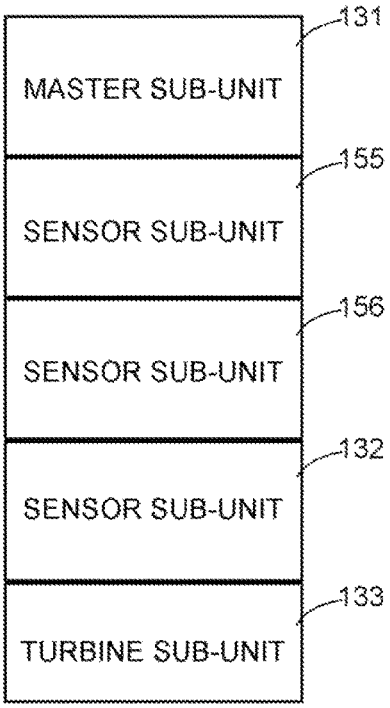
FIG. 4 is a block diagram of a downhole logging tool configuration including a master sub-unit, multiple sensor sub-units, and a turbine sub-unit.

FIG. 4 shows a more complex configuration of sub-units in a downhole logging tool. The configuration of FIG. 5 includes the master sub-unit 131, the sensor sub-unit 132, and the turbine sub-unit 133 as in FIG. 4. In addition, two more sensor sub-units 155, 156 have been added between the master sub-unit 131 and the sensor sub-unit 132. The master sub-unit 131 periodically sends the present real-time value to the sensor sub-units 132, 155, and 156. The master sub-unit 131 also functions as a data bus mater by periodically sending bus commands to addressed ones of the sensor sub-units 132, 155, 156. The addressed one of the sensor sub-units responds to the buss command from the master sub-unit 131 by returning either an acknowledgement or a request to the master sub-unit. For example, the request is a request to send a reset signal to the surface via mud pulse telemetry.

Figure 5:
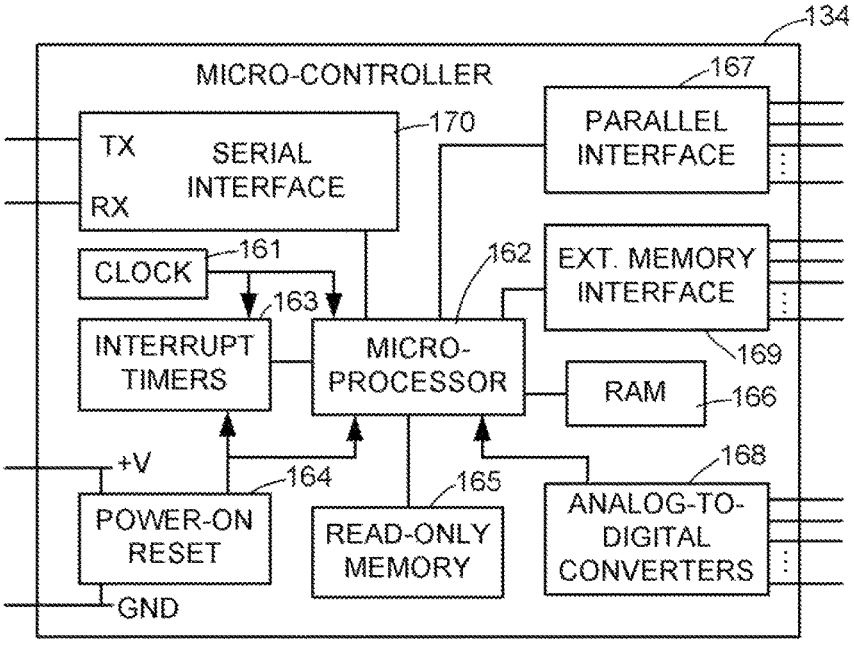
FIG. 5 is a block diagram of a micro-controller used in a master sub-unit or a sensor sub-unit.

FIG. 5 shows details of the micro-controller 134 of the master sub-unit. The micro-controller in a sensor sub-unit has a similar construction. The micro-controller 134 has a clock 161, a micro-processor 162 clocked by the clock 161, and interrupt timers 163 clocked by the clock 161. The micro-controller 134 has a power-on reset circuit that shuts down the micro-processor 162 when the supply of power to the micro-controller 134 is shut off, and resets the micro-processor 162 when the supply of power is restored. The micro-controller 134 has a read-only memory 165 for storing a control program executed by the micro-processor 162, and random access memory (RAM) 166 for storing results of program execution and for buffering data received by and transmitted by the micro-processor. The micro-controller 134 has a parallel interface 167 for driving a mud pulser and for transmitting or receiving single-bit sensor data. The micro-controller 134 has analog-to-digital converters 168 for sampling analog sensor data. The micro-controller 134 has an external memory interface 169 for storing and retrieving data from flash memory.

Figure 6:
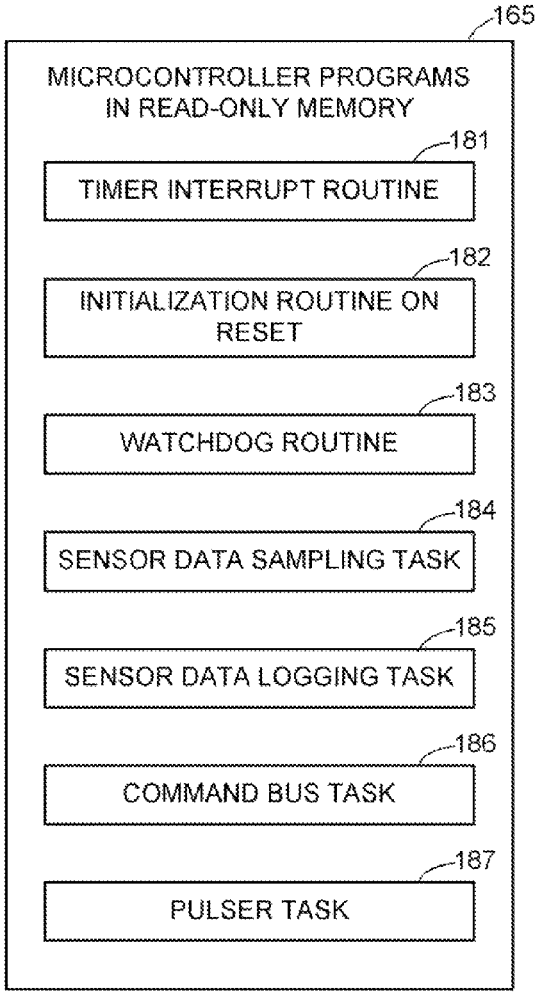
FIG. 6 is a block diagram of various computer program routines in read-only memory of the micro-controller of FIG. 5.

FIG. 6 is a block diagram of various control program routines in the read-only memory 165. A timer interrupt routine 181 is invoked every millisecond by an interrupt timer in order to update a local clock indicating a duration of time since the last reset, and to initiate or reschedule task execution. The power-on reset begins execution of an initialization routine 182, which includes incrementing a reset count indicating the number of resets since the well logging tool was inserted into the wellbore. A watchdog routine 183 is invoked every second to check whether or not various tasks have been active over the last second interval, and to reset the micro-controller if any one of these tasks has not been active over the last second interval. The various tasks include a sensor data sampling task 184, a sensor data logging task 185, a command bus task 186, and a pulser task 187.

Figure 7:
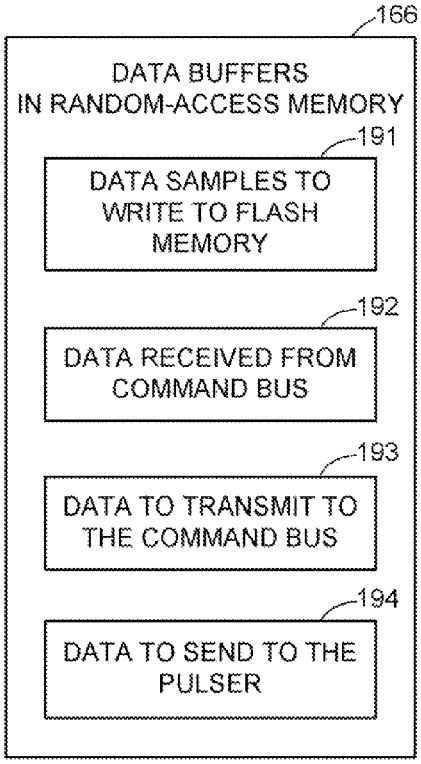
FIG. 7 is a block diagram of various data buffers in random access memory of the micro-controller of FIG. 5.

FIG. 7 shows various data buffers in random access memory 166. The buffers include a buffer 191 used by the sensor data logging task to write data samples to a sensor log in the flash memory. The command bus task uses a buffer 192 for buffering data received from the command bus, and a buffer 193 for buffering data to be transmitted to the command bus. The pulser task uses a buffer 194 for buffering data to be sent to the pulser.

Figure 8:
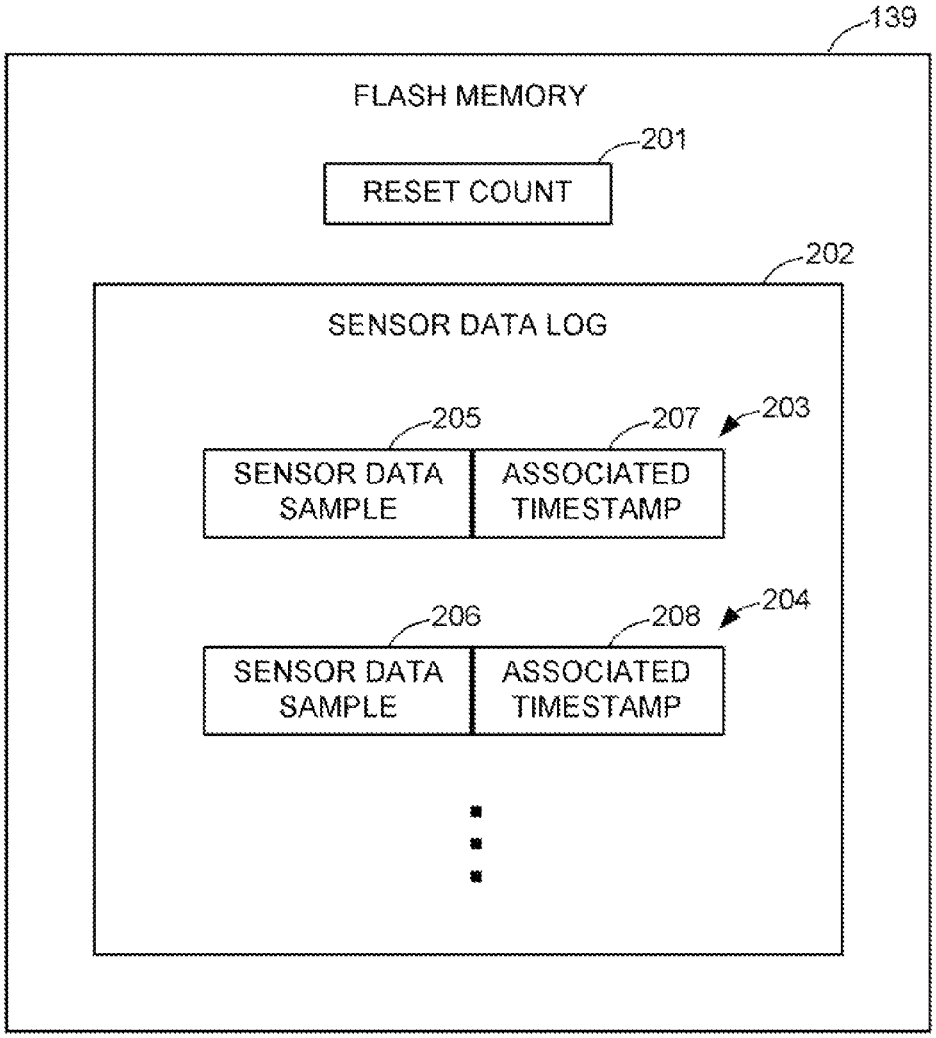
FIG. 8 is a block diagram of data structures in flash memory of a sensor sub-unit.

FIG. 8 is a block diagram of data structures in flash memory 139 of a sensor sub-unit. The data structures include the reset count 201, and the sensor data log 202. The sensor data log 202 is comprised of a series of variable-length records of various types. Each record starts with a record delimiter, and each record includes a record type, a record size, a variable length of record data, and finally a checksum. The records include sensor data records 203, 204. Each sensor data record includes a sensor data sample 205, 206 and an associated timestamp 207, 208 indicating when the sensor data sample was obtained from a sensor.

Because the well logging tool can be configured in various ways, a sensor sub-unit may or may not have a real-time clock, and a sensor sub-unit that does not have a real-time clock may or may not have access to a real-time clock in another sub-unit of the well logging tool. Consequently, the sensor samples in the sensor log may be time-stamped with either the time since the last reset, or a real-time value. Problems will arise if the time since the last reset is confused with a real-time value.

The real-time clock in the well logging tool typically is not as precise or accurate as a real-time clock at the surface of the wellbore. The real-time clock in the well logging tool is subject to more extreme temperature variations in the wellbore. The real-time clock at the surface can use the Global Positioning System (GPS) in order to compensate for clock drift. Therefore there may be a loss of accuracy if a real-time value from a downhole clock is confused with a real-time value of a more accurate real-time clock at the surface.

In addition, there may be loss of signals between sub-units of the well logging tool as well as loss of power. Consequently, a local time value associated with the sensor samples in the sensor log may or may not have been corrected as desired for drift by comparison to a real-time clock. In an extreme case, the reset time for one or more runs of sensor data may not be known when the computer at the surface is processing the sensor logs from the downhole logging tool.

To address one or more of these problems, a time stamp in the sensor data log of the sensor sub-unit has a flag (211 in FIG. 9 and FIG. 10) indicating whether the time is either a real-time value or else a duration of time since a reset of the micro-controller of the sensor sub-unit. In addition, the time-stamp has a flag (212 in FIG. 9 and FIG. 10) indicating whether or not the time was subject to a synchronization event. A synchronization event is an event that adjusts the normal advancement of the time value, so that each synchronization event has a time offset associated with it. The time offset is the difference between the time value just after the event and the time value just before the event. For example, the time offset is an adjustment for drift of the local clock in the sensor sub-unit with respect to a more stable or accurate clock in the master sub-unit or in a GPS-based clock at the surface.

FIG. 9 shows an example of a sensor log record format 210 of a local time value expressed as a duration of time since a certain reset in the sensor sub-unit. The format 210 includes a logic "1" for the flag 211 indicating that the time value is expressed as a duration of time since a certain reset. The certain reset is indicated by a reset number 213. The reset number 213 is a value obtained from the reset count (201 in FIG. 8) maintained by the initialization routine in the flash memory of the sensor sub-unit. The duration of time is indicated by a field 214 containing the number of seconds since the reset indicated by the reset count 213. This duration of time is maintained by the interrupt timer routine in the random access memory (RAM) of the micro-controller of the sensor sub-unit. For example, the duration of time can be a nineteen-bit number so that the duration of time indicated by the nineteen-bit number can be up to about six days.

FIG. 10 shows a sensor log record format 220 of a real time value. In this case, the format 220 includes the flag 211 indicating that the value is not expressed as a duration of time since a certain reset, the flag 212 indicating whether or not the time was subject to a synchronization event, and a field 215 indicating the real time. For example, the flag 211 is a logic zero ("0") indicating that the time is not a duration of time since a certain reset, the flag 212 may or may not indicate that the time was subject to a synchronization event, the field 215 indicates the real time in seconds since the start of Jan. 1, 2012, and the field 215 contains thirty bits so that the field may store real-time values for up to thirty-four years since Jan. 1, 2012.

FIG. 11 shows a table 230 defining three fields of a sensor log record for recording a synchronization event for a sub-unit. A log record of a synchronization event includes a first field containing a tool identifier, a second field containing the local time just before the synchronization event, and a third field containing the synced time just after the synchronization event. The tool identifier identifies the sensor sub-unit and is used by the surface computer for putting this time correction event in the field report for this tool sub-unit. The local time and the synced time may have the format shown in FIG. 9 or FIG. 10. The surface computer uses the "just before" and the "just after" times to correlate the time before the syncing to the time after the syncing. For example, the surface computer computes an offset that is the difference between the "just after" time and the "just before" time, and uses the offset for correcting any other time values in the sensor log for the same reset preceding the event, and then the surface computer converts the corrected time values to real time values, and displays the real-time values as "wall clock" time in an hour, minute, and second format.

Figure 12:
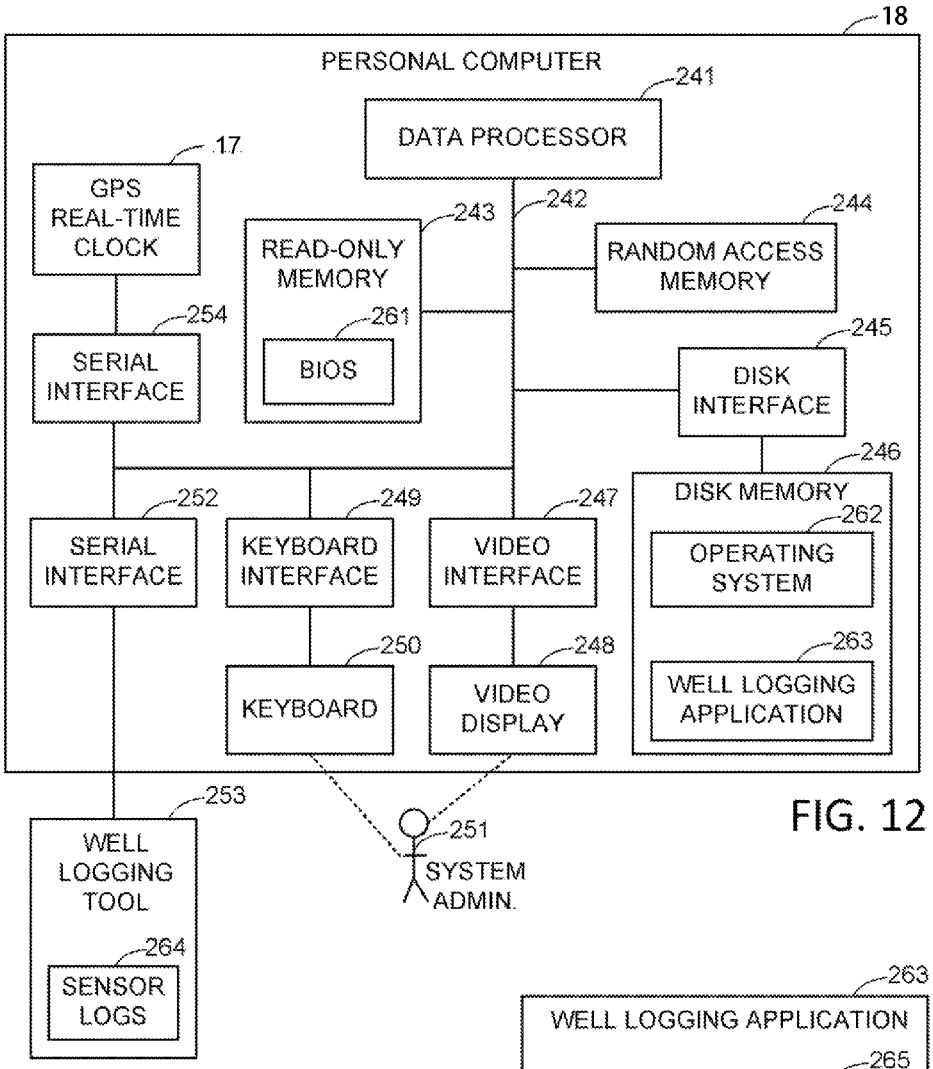
FIG. 12 is a block diagram of a personal computer configured for tracking time in the system of FIG. 1 and processing sensor logs to adjust time stamps in the sensor logs.

FIG. 12 shows details of the personal computer 18 configured for tracking time in the system of FIG. 1 and processing sensor logs to adjust time stamps in the sensor logs. The personal computer 18 has a data processor 241, which may contain multiple core CPUs and cache memory shared among the core CPUs. The data processor 241 has a system 242. The system bus 242 can be any of several types of bus structures including a memory bus or memory controller, a peripheral bus, and a local bus using any of a variety of bus architectures. Basic input/output routines (BIOS) stored in the read-only memory 243 or the like, provide basic routines that help to transfer information between elements within the personal computer 18, such as during start-up. The personal computer 18 also has random access memory 244, and computer-readable storage media such as disk memory 246 coupled to the system bus 242 via a disk interface 245. The disk memory 246 stores an operating system 262 of the personal computer 18, and also stores a well logging application program 263.

The personal computer 18 also has a video interface 247 and a video display 248, a keyboard interface 249 and a keyboard 250, and a serial interface 252 coupled to the command bus of a well logging tool 253. The keyboard 250 is operated by a system administrator 251 in order to monitor the processing of the sensor logs 264 that are downloaded from the well logging tool 253.

The personal computer 18 further has a serial interface 254 to a GPS unit that houses a real-time clock 17 from which real-time clock values can be read. For example, the GPS unit can provide Coordinated Universal Time (UTC) values with a precision of one millisecond in response to requests for data in accordance with the protocol of the National Marine Electronics Association (NMEA) Standard 0183.

Figure 13:
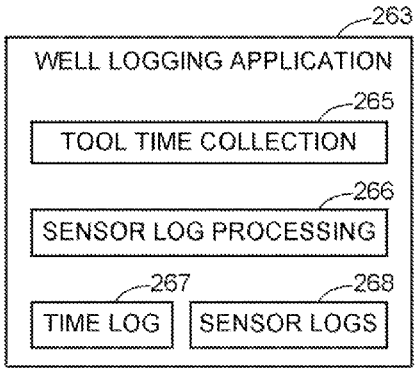
FIG. 13 is a block diagram of computer program routines and data structures of a well logging application of the personal computer of FIG. 12.
Figure 14:
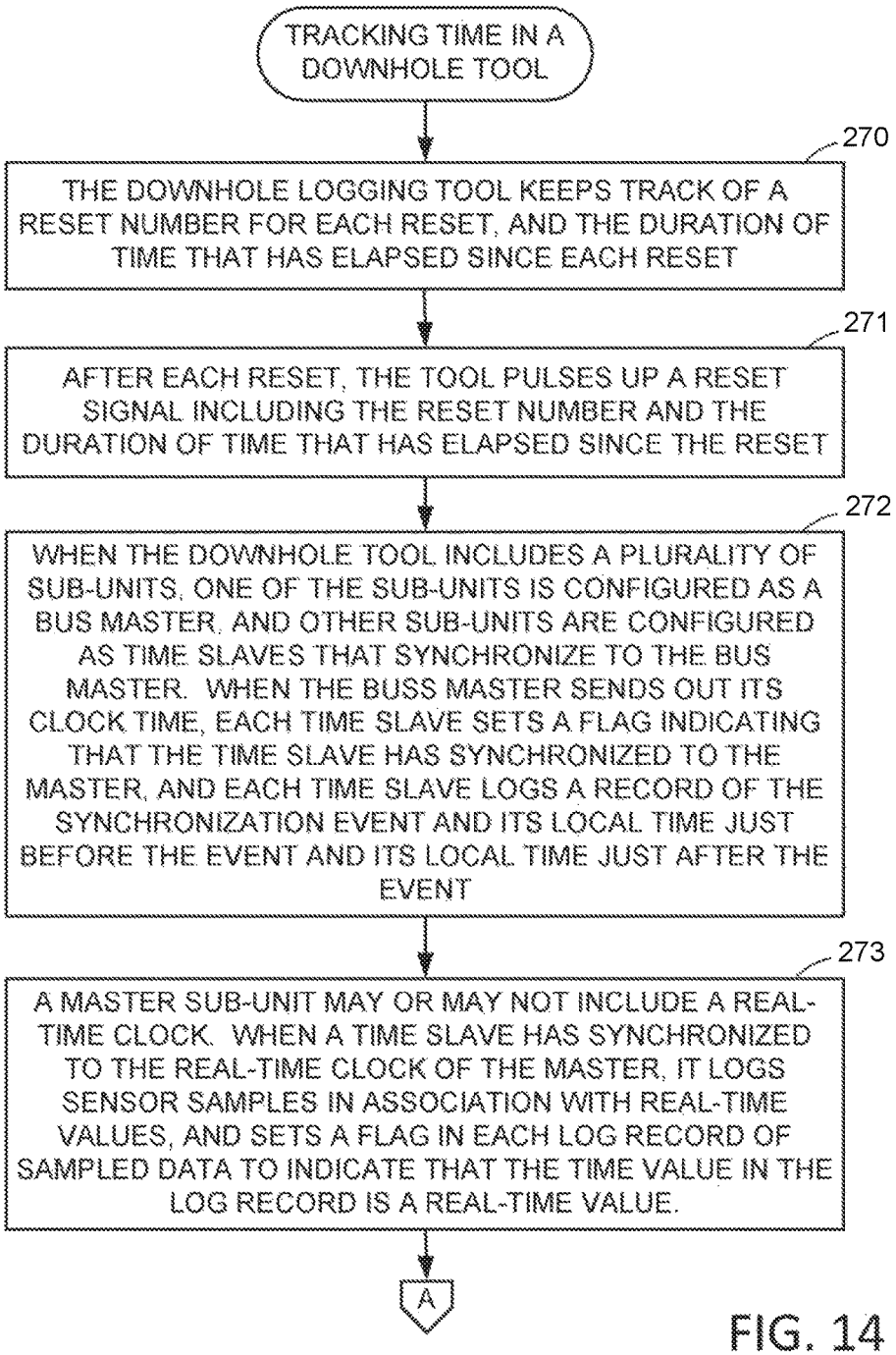
FIGS. 14, 15, 16, and 17 together comprise a flowchart of a method of tracking time in the system of FIG. 1.

FIG. 13 shows that the well logging application 263 includes a tool time collection program 264 executed when the well logging tool 253 is down the wellbore. Execution of the tool time collection program 264 produces a time log 265 that includes reset times and time values pulsed up from the well logging tool and associated real-time values indicating when these reset times and time values were pulsed up from the well logging tool. The well logging application 263 further includes a sensor log processing program 265 for processing sensor logs of the well logging tool 253 after the sensor logs have been downloaded to the personal computer (18 in FIG. 12). Execution of the sensor log processing program 265 produces sensor logs 257 including real-time values associated with the samples of sensor data in the sensor logs.

FIGS. 14, 15, 16, and 17 together comprise a flowchart of a method of tracking time in the system of FIG. 1. In a first step 270 of FIG. 14, the downhole logging tool keeps track of a reset number for each reset, and the duration of time that has elapsed since each reset. Next, in step 271, after each reset, the tool pulses up a reset signal including the reset number and the duration of time that has elapsed since the reset.

In step 272, when the downhole tool includes a plurality of sub-units, one of the sub-units is configured as a bus master, and other sub-units are configured as time slaves that synchronize to the bus master. When the bus master sends out its clock time, each time slave sets a flag indicating that the time slave has synchronized to the master, and each slave logs a record of the synchronization event and its local time just before the event and its local time just after the event.

In step 273, a master sub-unit may or may not include a real-time clock. When a time slave has synchronized to the real-time clock of the master, it logs sensor samples in association with real-time values, and sets a flag in each log record of sampled data to indicate that the time value in the log record is a real-time value. Execution continues from step 273 to step 274 in FIG. 15.

Figure 15:
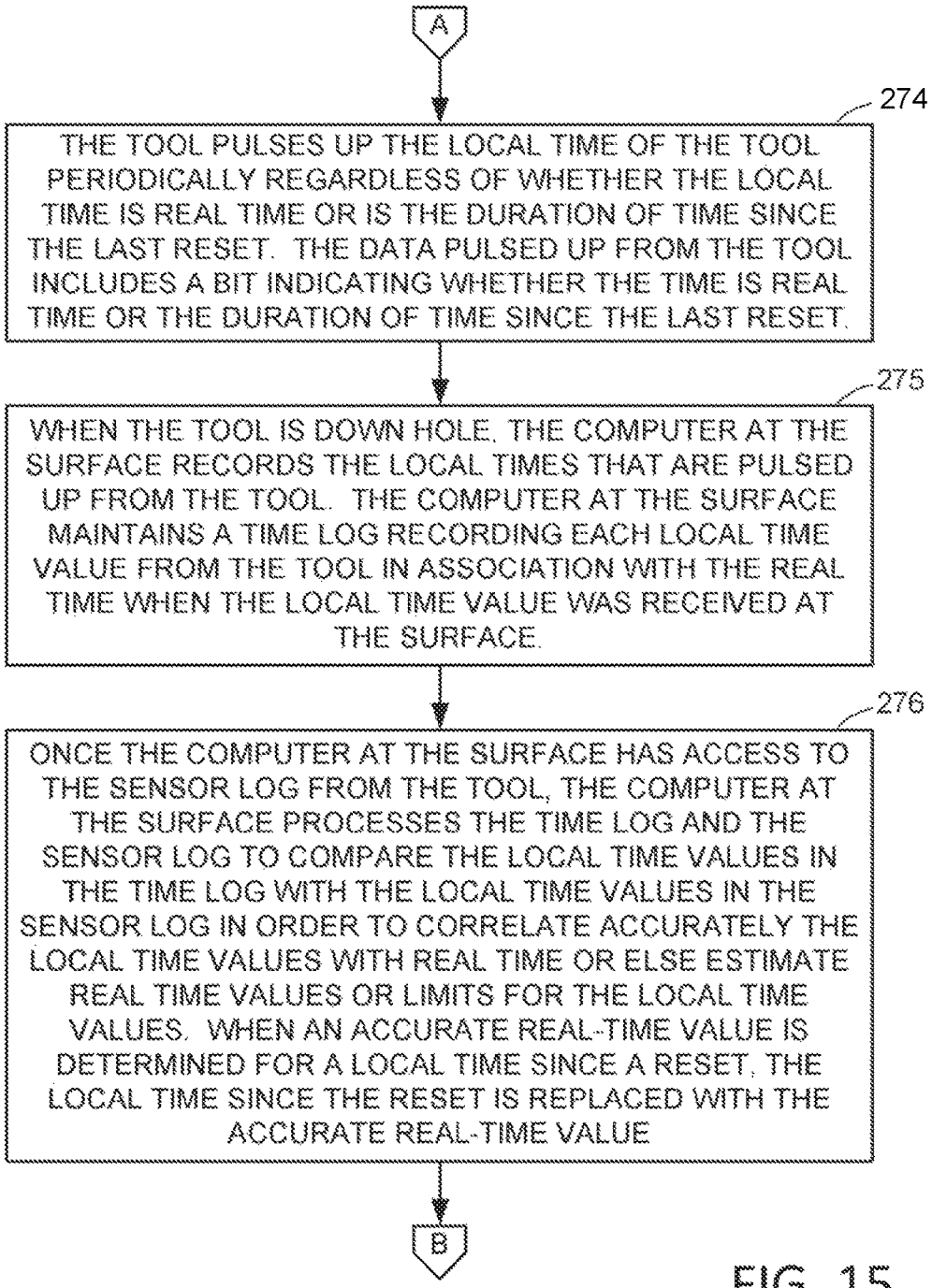

In step 274 of FIG. 15, the tool pulses up the local time of the tool periodically regardless of whether the local time is either real time or else is the duration of time since the last reset. The data pulsed up from the tool includes a bit indicating whether the local time is either real time or else the duration of time since the last reset. In step 275, when the tool is down hole, the computer at the surface records the local times that are pulsed up from the tool. The computer at the surface maintains a time log recording each local time value from the tool in association with the real time when the local time value was received at the surface.

In step 276, once the computer at the surface has access to the sensor log from the tool, the computer at the surface processes the time log and the sensor log to compare the local time values in the time log with the local time values in the sensor log in order to correlate accurately the local time values with real time or else estimate real time values or limits for the local time values. When an accurate real-time value is determined for a local time since a reset, the local time since the reset is replaced with the accurate real-time value. Execution continues from step 276 to step 277 of FIG. 16.

Figure 16:
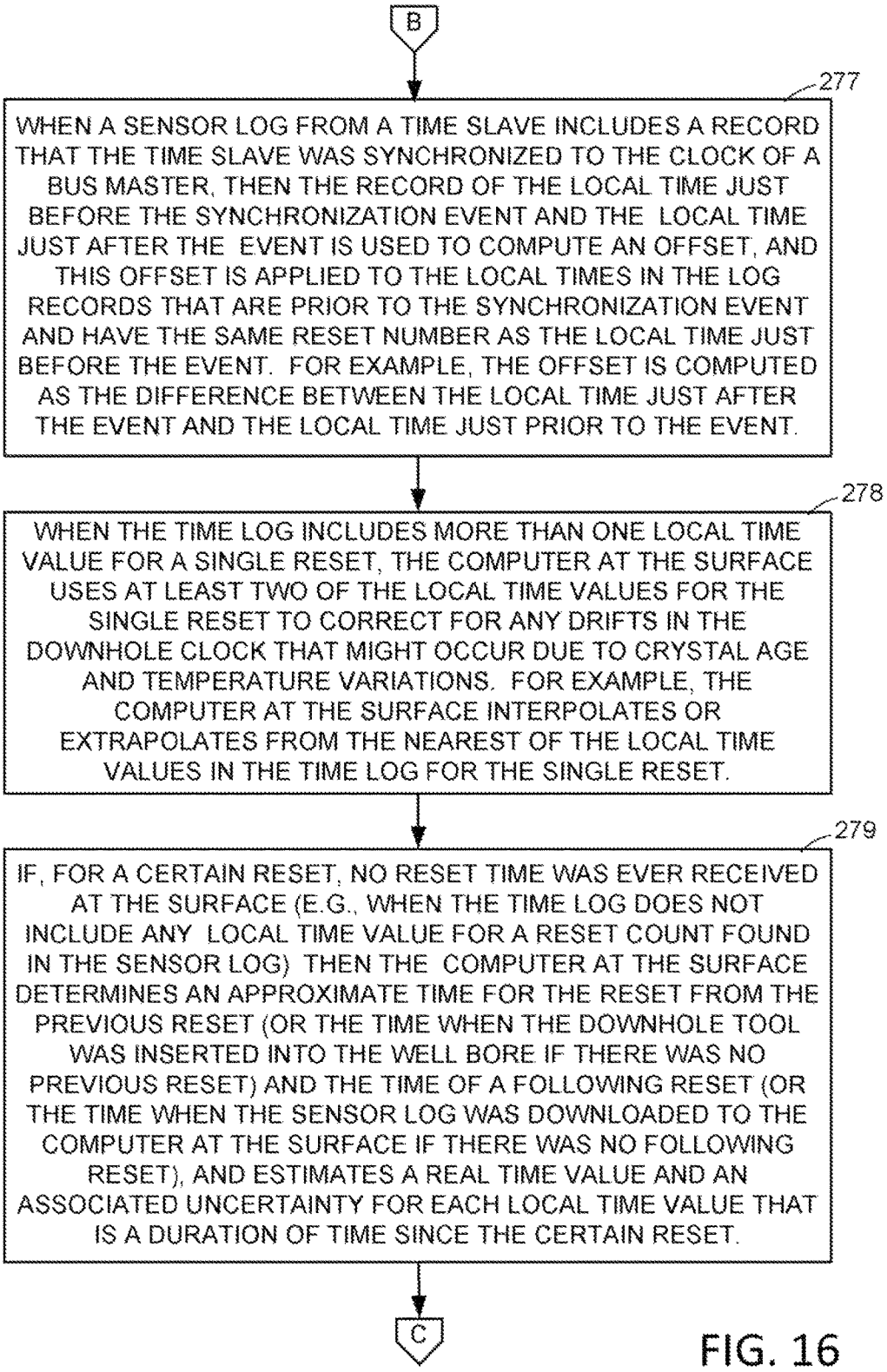

In step 277 of FIG. 16, when a sensor log from a time slave includes a record that the time slave was synchronized to the clock of a bus master, then the record of the local time just before and just after the event is used to compute an offset, and this offset is applied to the local times in the log records that are prior to the synchronization event and have the same reset number as the local time just before the event. For example, the offset is computed as the difference between the local time just after the event and the local time just before the event.

In step 278, when the time log includes more than one local time value for a single reset, the computer at the surface uses at least two of the local time values for the single reset to correct for any drifts in the downhole clock that might occur due to crystal age and temperature variations. For example, the computer at the surface interpolates or extrapolates from the nearest of the local time values in the time log for the single reset.

In step 279, if, for a certain reset, no reset time was ever received at the surface (e.g., when the time log does not include any local time value for a reset count found in the sensor log), then the computer at the surface determines an approximate time for the reset from the previous reset (or else the time when the downhole tool was inserted into the wellbore if there was no previous reset) and the time of a following reset (or else the time when the sensor log was downloaded to the computer at the surface if there was no following reset), and estimate a real time value and an associated uncertainty for each local time value that is a duration of time since the certain reset. Execution continues from step 279 to step 280 in FIG. 17.

Figure 17:
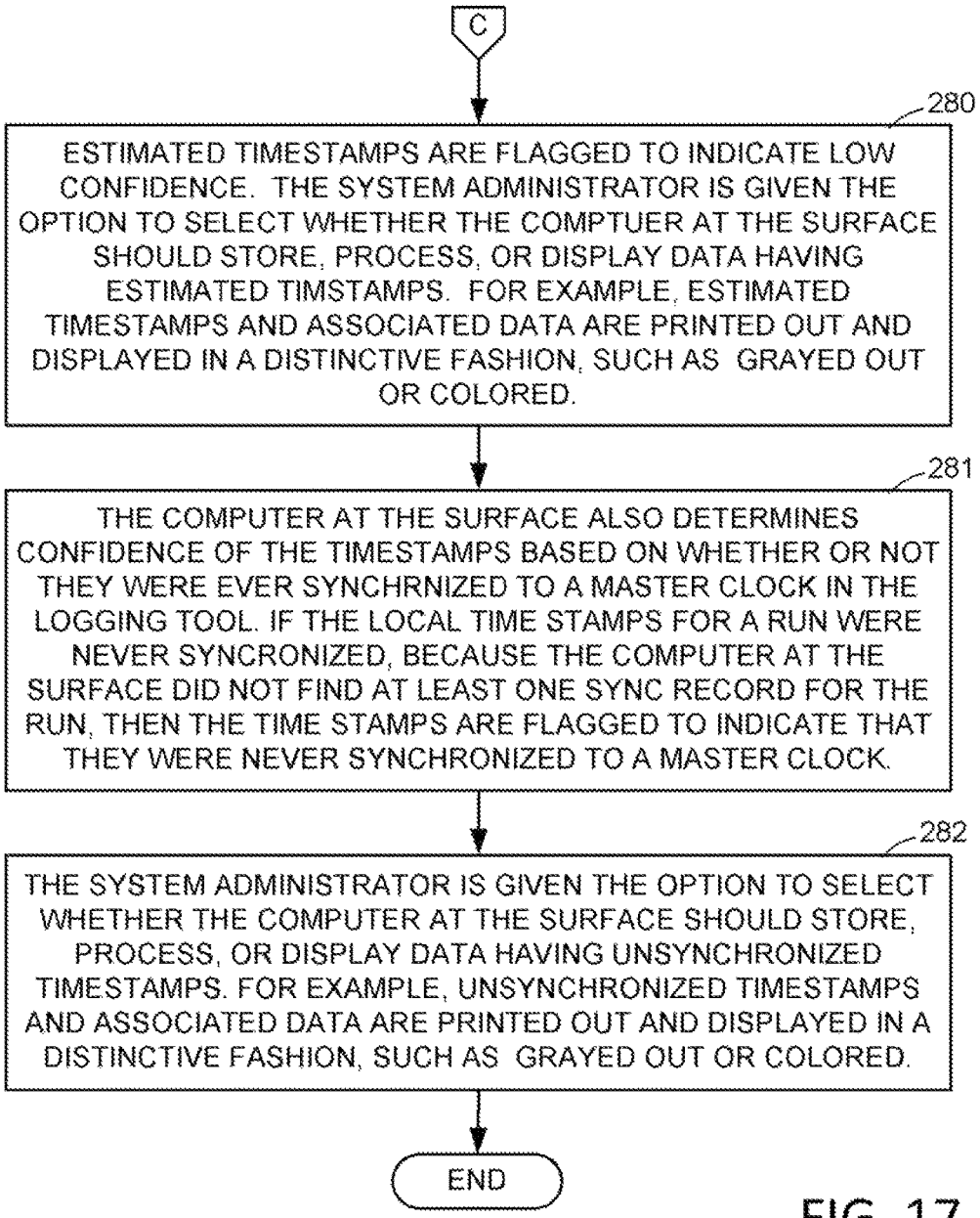

In step 280 of FIG. 17, the estimated timestamps are flagged to indicate low confidence so that the real-time stamps known with a high level of confidence are distinguished from the estimated real-time stamps when the surface computer inserts any estimated real-time stamps into the sensor log. For example, the surface computer flags each estimated real-time stamp in the sensor log so that any estimated real-time stamps are identified on any display of the sensor log to the system administrator, and the surface computer also records the associated uncertainty in the sensor log, so that system administrator may inquire as to the uncertainty of each estimated time stamp. For example, the low confidence data is shaded or displayed in a different color than the high confidence data on a print-out or on the video display to distinguish the low confidence data from the high confidence data. The system administrator may also be given options to select whether the computer at the surface should store, process, or display only the high confidence data. For example, the low confidence data can be used primarily for troubleshooting and/or when there is an absence of alternative high confidence data for wellbore conditions of interest.

In step 281, the computer at the surface also determines confidence of the timestamps based on whether or not the timestamps were ever synchronized to a master clock in the logging tool. In particular, the timestamps for a run would never have been synchronized if the sync bit was never set for a run of sensor data downloaded from the sensor log in the well logging tool, and the computer at the surface did not find at least one sync record for the run. For example, if the well logging tool has an accurate real-time clock in a master bus unit, there can be a significant difference in the accuracy of the local time stamps that have or have not been synchronized to the real-time clock of the master bus unit. Therefore, time stamps that never were synchronized to the real-time clock of the master bus unit are flagged in the log.

In step 282, the system administrator is given options to select whether the computer at the surface should store, process, or display sensor data that was not synchronized to the real-time clock of the master bus unit. For example, unsynchronized timestamps and associated data are printed out and displayed in a distinctive fashion, such as grayed out or colored.

FIG. 18 shows a specific example of a case were step 279 of FIG. 16 is applicable. FIG. 18 is a table 294 showing a correlation of local time in a sensor sub-unit with real-time and transmission of local time values from the sensor sub-unit to the surface at various times. In this example, no reset signal was ever received at the surface for the reset number 2.

In the example of FIG. 18, a first reset signal indicating the local time (1, 20) was sent from the sensor sub-unit in the wellbore, and this first reset signal was received at the surface, and the surface computer associated this local time (1, 20) with a real time value of 12:00:20. In this example, the notation "local time (1, 20)" means that the sub-unit clocked a local time of 20 seconds since the first reset after the logging tool was inserted into the wellbore. A second reset signal indicating the local time (1, 40) was sent from the sensor sub-unit in the wellbore and received at the surface, and the surface computer associated this local time (1, 40) with a real-time value of 12:00:40. A third reset signal indicating the local time (3,20) was sent from the sensor sub-unit in the wellbore and received at the surface, and the surface computer associated this local time (3, 20) with a real-time value of 12:01:30.

Based on these three reset signals, the surface computer determines that the first reset occurred at 12:00:00 and lasted at least forty seconds, because the last reset signal that was received at the surface and that included the reset number "1", and also the last sensor log entry that included the reset number "1" had a local time of forty seconds since the first reset. In a similar fashion, the surface computer also determines that the third reset occurred at 12:01:00 and lasted at least twenty seconds. Based on this data, the second reset happened during the time period of 12:00:40 to 12:00:10. In addition, the second reset lasted at least ten seconds, because the last local time in the sensor log including the reset number "2" has an associated duration of time of ten seconds. Therefore the second reset is more precisely determined to have happened during the time period of 12:00:40 to 12:01:00. Using this technique, the computer at the surface correctly time stamps a real-time value upon all of the sensor samples in the log collected during the runs of the first and third resets, and time stamps all of the sensor samples collected during the run of the second reset to an accuracy within +/−ten seconds. For example, the real time of the second reset at the local time of (2, 0) is estimated to be 12:00:50, and the real time of the sensor data sample at the local time of (2, 10) is estimated to be 12:01:00. The estimated timestamps are distinguished from the other more accurate timestamps in the table 294 by displaying the estimated timestamps in dashed line rectangles.

As described above, time is tracked in a downhole tool during well logging while drilling a wellbore. The same method of tracking time can be used for wireline well logging after the drilling of a wellbore, or for well logging when using slickline or coiled tubing. In general, data from the sensor data log is processed as described above in order to adjust time values from the log when the time values are not precise or accurate real-time values. For example, during well logging while drilling as described above, the log might not contain precise or accurate real-time values associated with the sensor data samples due to power loss or due to an unreliable or intermittent connection for data transmission between the surface and the master sub-unit (131 in FIG. 2).

For example, it is possible for well logging while drilling to use a high-speed data connection between the surface and the master sub-unit (131 in FIG. 2). For example, Ethernet wire or optical fiber cable could be incorporated into the drill pipe of the drill string (32 in FIG. 1). This is generally known as "wired pipe." By employing the logging techniques described above during drilling with wired pipe, the high-speed data connection could normally ensure that the sensor data log would contain precise and accurate real time values associated with the sensor data samples and synchronized to the real-time clock (17 in FIG. 1) at the surface. However, there could be a loss of power to the sub-units, and if the high-speed data connection is not available due to an intermittent connection in the wired pipe when power is restored to the sub-units, then the sensor data log could contain timestamps that would not be synchronized to a real-time clock. In this case the sensor data log could be processed as described above in order to handle these unsynchronized timestamps.

In another example of logging while drilling using wired pipe, the personal computer (18 in FIG. 1) would normally record a log at the surface while drilling. During drilling, sensor data would be streamed from the downhole master sub-unit (131 in FIG. 4) to the personal computer 18. The personal computer 18 would log each sensor data sample in association with a timestamp synchronized to the real-time clock (17 in FIG. 1) at the surface. The timestamp could have the format as shown in FIG. 10 as described above, and the flag 212 could be set to indicate that the real-time value 215 would be synchronized to the real-time clock 17. While the personal computer 18 would be logging sensor data at the surface, each sensor sub-unit in the downhole tool assembly would be logging data from the sensor sub-unit as described above with respect to FIGS. 5 to 11. In this example, the log recorded at the surface would normally be used for analysis of the sensor data, and the log recorded in each sensor-sub-unit would be used as a backup log. In other words, the log recorded in each sensor sub-unit would be used as described above with respect to FIGS. 14-18 in the event that the log recoded at the surface would be incomplete or corrupted or unavailable due to a failure of the high-speed data connection in the wired pipe or due to a failure of the personal computer 18.

Wireline logging after the drilling of a wellbore could use the technique just described above in which a computer at the surface would record a log at the surface while each downhole sensor sub-unit would record a backup log in the sensor sub-unit. In this example, the log recorded in each sensor sub-unit would be used as described above with respect to FIGS. 14-18 in the event that the log recorded at the surface would be incomplete or corrupted or unavailable due to a failure of the wireline data connection or due to a failure of the computer at the surface.

Logging when using slickline (30 in FIG. 1) or coiled tubing (28 in FIG. 1) could use any of the techniques described above depending on the availability of a data connection between the master sub-unit and a computer at the surface. If no data connection is available or if a low-speed or intermittent data connection is available, then the techniques could be similar to those described above with respect to FIGS. 1 to 18 for the case of logging while drilling using mud-pulse or acoustic data transmission between the master sub-unit and a computer at the surface. If a high-speed data connection is available, such as an Ethernet wire or optical fiber link, then the techniques could be similar to those described above for logging using wired pipe or wireline logging.

Further to the environmental context of a subterranean well depicted in FIG. 1, the sensor sub-unit(s) 35, 36, 52 can be deployed on a drill string 132 as illustrated. Alternatively, the sensor sub-unit(s) 35, 36, 52 can be deployed on coiled tubing 128. The sensor sub-unit(s) 35, 36, 52 can also be deployed on wireline 130. As depicted, the sensor sub-unit(s) can be utilized in measurement while drilling (MWD) and logging while drilling (LWD) procedures.

In view of the above, there has been described a method and system for tracking time in a downhole tool in order to indicate whether timestamps associated with data samples or events in a log indicate either real time or a duration of time since a certain reset, and to indicate whether the timestamps have been synchronized with a master clock in the tool. The log also records the time and offset of each synchronization event. A computer processes the log to convert all of the timestamps to real-time values and to indicate timestamps that have been estimated and timestamps that were never synchronized to a master clock in the tool. The computer determines an associated uncertainty for each of the estimated timestamps.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method of tracking time in a downhole tool, the method comprising:

powering up and resetting a first sub-unit of the downhole tool;

starting a first clock in the first sub-unit so that the first clock keeps track of the duration of time since the first sub-unit was powered up and reset, the first sub-unit logging sensor data samples and associated timestamps from the first clock in a log;

establishing communication from a second sub-unit in the tool to the first sub-unit and sending a timestamp from a second clock in the second sub-unit to the first sub-unit, and thereafter the first sub-unit logging sensor data samples and associated timestamps synchronized to the second clock in the log, and the first sub-unit logging an indication in the log that the timestamps have been synchronized to the second clock;

processing data downloaded from the log; and using the indication in the log that the timestamps have been synchronized to the second clock to adjust the timestamps that were logged prior to the first sub-unit obtaining a timestamp from the second clock.

2. The method as claimed in claim 1, further comprising the first sub-unit setting a flag in a field of each timestamp in the log to indicate whether or not said each timestamp in the log is synchronized to the second clock.

3. The method as claimed in claim 1, further comprising the first sub-unit setting a flag in a field of each timestamp in the log to indicate whether or not said each timestamp in the log indicates a real-time value instead of indicating a duration of time since a last reset of the first sub-unit, wherein the second clock is a real-time clock.

4. The method as claimed in claim 1, further comprising:

wherein the indication in the log that the timestamps have been synchronized to the second clock includes a record of a synchronization event, the record of the synchronization event indicating an offset between the first clock and the second clock, wherein the processing of data downloaded from the log includes reading the record of the synchronization event to obtain the offset, and wherein the offset is used to adjust the associated timestamps that were recorded in the log after the reset of the first sub-unit and prior to the first sub-unit logging the associated timestamps synchronized to the second clock.

5. The method as claimed in claim 4, further comprising:

wherein the record of the synchronization event includes a timestamp of a time value just prior to the synchronization event, wherein the record of the synchronization event includes a timestamp of a time value just after the synchronization event, and wherein the offset is obtained by computing a difference between the time value just after the synchronization event and the time value just before the synchronization event.

6. The method as claimed in claim 1, wherein the processing of data downloaded from the log comprises: (i) identifying, in the log, timestamps produced from the first clock in response to another reset for which none of the timestamps from the first clock in the log were ever synchronized to the second clock, and (ii) for the identified timestamps, computing estimates of real-time values for the identified timestamps based on other timestamps in the log associated with resets of the first sub-unit occurring just before said another reset and occurring just after said another reset.

7. The method as claimed in claim 6, wherein the processing of data downloaded from the log further comprises computing uncertainties for the estimates of the real-time values for the identified timestamps based on other timestamps in the log associated with resets of the first sub-unit occurring just before said another reset and occurring just after said another reset.

8. The method as claimed in claim 1, wherein the processing of data downloaded from the log comprises: (i) identifying, in the log, timestamps produced from the first clock in response to another reset for which none of the timestamps in the log were ever synchronized to the second clock, and (ii) indicating the timestamps produced from the first clock in response to another reset for which none of the timestamps in the log were ever synchronized to the second clock.

9. A system for tracking time in a downhole tool, the system comprising:

a computer for processing data and a downhole tool including a first sub-unit and a second sub-unit, the first sub-unit having a first clock and the second sub-unit having a second clock; and wherein powering up and resetting the first sub-unit starts the first clock so that the first clock keeps track of the duration of time since the first sub-unit was powered up and reset, wherein the first sub-unit has a micro-processor and nonvolatile memory storing a control program that, when executed by the micro-processor, causes the micro-processor to perform: (i) logging of sensor data samples and associated timestamps from the first clock in a log, and (ii) establishing communication from the second sub-unit and obtaining a timestamp from the second clock, and thereafter logging sensor data samples and associated timestamps synchronized to the second clock in the log, and logging an indication in the log that the timestamps have been synchronized to the second clock, and wherein the computer has a data processor and a computer-readable storage device storing instructions that, when executed by the data processor, cause the data processor to perform a method of processing data downloaded from the log, and, during the processing of the data downloaded from the log, using the indication in the log that the timestamps have been synchronized to the second clock to adjust the timestamps that were logged prior to the first sub-unit obtaining a timestamp from the second clock.

10. The system as claimed in claim 9, wherein the indication in the log that the timestamps have been synchronized to the second clock includes a record of a synchronization event indicating an offset between the first clock and the second clock, and wherein the instructions, when executed by the data processor, cause the data processor to read the record of the synchronization event to obtain the offset, and to use the offset to adjust the associated timestamps that were recorded in the log after the reset of the first sub-unit and prior to the logging of the associated timestamps synchronized to the second clock.

11. The system as claimed in claim 10, wherein the record of the synchronization event includes a timestamp of a time value just prior to the synchronization event, and the record of the synchronization event includes a timestamp of a time value just after the synchronization event, and the instructions, when executed by the data processor, cause the data processor to obtain the offset by computing a difference between the time value just after the synchronization event and the time value just before the synchronization event.

12. The system as claimed in claim 9, wherein the instructions, when executed by the data processor, cause the data processor to process the data from the log to identify, in the log, timestamps produced from the first clock in response to another reset for which none of the timestamps of the first clock were ever synchronized to the second clock, and for the identified timestamps, to compute estimates of real-time values for the identified timestamps based on other timestamps in the log associated with resets of the first sub-unit of the downhole tool occurring just before said another reset and occurring just after said another reset.

13. The system as claimed in claim 12, wherein the instructions, when executed by the data processor, cause the data processor to process the data from the log to compute uncertainties for the estimates of the real-time values for the identified timestamps based on other timestamps in the log associated with resets of the first sub-unit of the downhole tool occurring just before said another reset and occurring just after said another reset.

14. The system as claimed in claim 9, wherein the instructions, when executed by the data processor, cause the data processor to (i) process the data from the log to identify, in the log, timestamps produced from the first clock in response to another reset for which none of the timestamps of the first clock were ever synchronized to the second clock, and (ii) indicate the timestamps produced from the first clock in response to another reset for which none of the timestamps in the log were ever synchronized to the second clock.

15. A computer-readable storage device storing instructions that, when executed by a data processor of a computing device comprise causing the data processor to:

process data downloaded from a log of a downhole tool, wherein the downhole tool includes a first sub-unit having a first clock that kept track of a duration of time since powering up and resetting the first sub-unit, and a second sub-unit including a second clock, wherein the log includes samples of sensor data and associated timestamps, the timestamps including: (i) timestamps that were produced by the first clock and were not synchronized to the second clock of the downhole tool, and (ii) timestamps that were synchronized to the second clock of the downhole tool after the first sub-unit obtained a timestamp from the second clock, and the log including an indication that the timestamps have been synchronized to the second clock; and use the indication that the timestamps have been synchronized to the second clock to adjust timestamps that were not synchronized to the second clock and were logged prior to the first sub-unit obtaining a timestamp from the second clock.

16. The computer-readable storage device as claimed in claim 15, further comprising:

wherein the indication that the timestamps have been synchronized to the second clock includes a record of a synchronization event, the record of the synchronization event indicating an offset between the first clock and the second clock, and wherein the instructions, when executed by the data processor, further comprise causing the data processor to read the record of the synchronization event to obtain the offset, and to use the offset to adjust the timestamps that were not synchronized to the second clock and were logged prior to the first sub-unit obtaining the timestamp from the second clock.

17. The computer-readable storage device as claimed in claim 16, wherein the record of the synchronization event includes: (i) a timestamp of a time value just prior to the synchronization event, and (ii) a timestamp of a time value just after the synchronization event, and wherein the instructions, when executed by the data processor, further comprise causing the data processor to obtain the offset by computing a difference between the time value just after the synchronization event and the time value just before the synchronization event.

18. The computer-readable storage device as claimed in claim 15, wherein the instructions, when executed by the data processor, further comprise causing the data processor to process the data from the log to identify, in the log, timestamps produced from the first clock in response to another reset for which none of the timestamps of the first clock were ever synchronized to the second clock, and for the identified timestamps, to compute estimates of real-time values for the identified timestamps based on other timestamps in the log associated with resets of the sub-unit of the downhole tool occurring just before said another reset and occurring just after said another reset.

19. The computer-readable storage device as claimed in claim 18, wherein the instructions, when executed by the data processor, further comprise causing the data processor to process the data from the log to compute uncertainties for the estimates of the real-time values for the identified timestamps based on other timestamps in the log associated with resets of the first sub-unit occurring just before said another reset and occurring just after said another reset.

20. The computer-readable storage device as claimed in claim 15, wherein the instructions, when executed by the data processor, further comprise causing the data processor to process the data from the log to identify, in the log, timestamps produced from the first clock in response to another reset for which none of the timestamps in the log were ever synchronized to the second clock, and indicating the timestamps produced from the first clock in response to another reset for which none of the timestamps in the log were ever synchronized to the second clock.

* * * * *